US009183730B1

(12) United States Patent
Wiley et al.

(10) Patent No.: US 9,183,730 B1
(45) Date of Patent: Nov. 10, 2015

(54) METHOD AND SYSTEM FOR MITIGATING INVASION RISK ASSOCIATED WITH STRANGER INTERACTIONS IN A SECURITY SYSTEM ENVIRONMENT

(71) Applicant: Numerex Corp., Atlanta, GA (US)

(72) Inventors: Scott E. Wiley, Atlanta, GA (US); Johnny Tyree Thompson, Atlanta, GA (US)

(73) Assignee: Numerex Corp., Atlanta, GA (US)

( * ) Notice: Subject to any disclaimer, the term of this patent is extended or adjusted under 35 U.S.C. 154(b) by 0 days.

(21) Appl. No.: 14/332,794

(22) Filed: Jul. 16, 2014

(51) Int. Cl.
*G08B 29/00* (2006.01)
*G08B 25/00* (2006.01)

(52) U.S. Cl.
CPC ..... *G08B 25/001* (2013.01); *G08B 25/008* (2013.01)

(58) Field of Classification Search
CPC .. G08B 25/001; G08B 25/002; G08B 25/008; G08B 25/009; G08B 25/014; G08B 25/016; G08B 25/14; G08B 1/00; G08B 29/00; G08B 29/02; H04W 64/00; H04W 64/006
USPC ..... 340/540, 541, 506, 521, 527, 531; 455/404.1, 404.2, 412.2, 424
See application file for complete search history.

(56) References Cited

U.S. PATENT DOCUMENTS 4,465,904 A 8/1984 Gottsegen et al.
4,692,742 A 9/1987 Raizen et al.
4,918,717 A 4/1990 Bissonnette et al.
5,134,644 A 7/1992 Garton et al.
5,195,126 A 3/1993 Carrier et al.
5,365,568 A 11/1994 Gilbert
5,400,011 A 3/1995 Sutton
5,463,595 A 10/1995 Rodhall
5,568,475 A 10/1996 Doshi et al.
5,736,927 A 4/1998 Stebbins et al.
5,796,633 A 8/1998 Burgess et al.
5,808,547 A 9/1998 Carney
5,838,223 A 11/1998 Gallant et al.
5,877,684 A 3/1999 Lu
5,923,731 A 7/1999 McClure
5,940,474 A 8/1999 Ruus
6,075,451 A 6/2000 Lebowitz et al.
6,215,404 B1 4/2001 Morales
6,243,373 B1 6/2001 Turock
6,272,212 B1 8/2001 Wulforst et al.
6,288,642 B1 9/2001 Dohrmann
6,311,072 B1 10/2001 Barclay et al.
6,369,705 B1 4/2002 Kennedy
6,381,307 B1 4/2002 Jeffers et al.
6,400,265 B1 6/2002 Saylor et al.

(Continued)

*Primary Examiner* — Hung T Nguyen
(74) *Attorney, Agent, or Firm* — King & Spalding LLP

(57) ABSTRACT

A security system can mitigate invasion risk faced by a homeowner or other person responding to a stranger who is seeking to interact with the responder or to gain premises access, for example when a supposed deliveryman approaches the front door. The homeowner can make an entry into a user interface of the security system in preparation for interacting with the stranger, such as to answer the front door. If the user does not make a second entry within a specified period of time indicating that the interaction was safely completed, the security system can raise an alarm or otherwise dispatch help. If the stranger turns out to be an intruder and forces the homeowner to make the second, all-clear entry, the homeowner can make a duress entry that appears to be an all-clear entry but in fact triggers a silent alarm or otherwise summons help.

20 Claims, 6 Drawing Sheets

(56) References Cited

U.S. PATENT DOCUMENTS

| | | | |
|---|---|---|---|
| 6,438,124 | B1 | 8/2002 | Wilkes et al. |
| 6,452,490 | B1 | 9/2002 | Garland et al. |
| 6,493,435 | B1 | 12/2002 | Petricoin |
| 6,553,100 | B1 | 4/2003 | Chen et al. |
| 6,574,480 | B1 | 6/2003 | Foladare et al. |
| 6,577,234 | B1 | 6/2003 | Dohrmann |
| 6,603,845 | B2 | 8/2003 | Jensen et al. |
| 6,661,340 | B1 | 12/2003 | Saylor et al. |
| 6,683,526 | B2 | 1/2004 | Bellin |
| 6,829,478 | B1 | 12/2004 | Layton et al. |
| 6,831,557 | B1 | 12/2004 | Hess |
| 6,870,906 | B2 | 3/2005 | Dawson |
| 6,928,148 | B2 | 8/2005 | Simon et al. |
| 6,965,313 | B1 | 11/2005 | Saylor et al. |
| 6,973,165 | B2 | 12/2005 | Giacopelli et al. |
| 7,002,462 | B2 | 2/2006 | Welch |
| 7,009,519 | B2 | 3/2006 | Leonard et al. |
| 7,103,152 | B2 | 9/2006 | Naidoo et al. |
| 7,113,090 | B1 | 9/2006 | Saylor et al. |
| 7,119,609 | B2 | 10/2006 | Naidoo et al. |
| 7,245,703 | B2 | 7/2007 | Elliot et al. |
| 7,262,690 | B2 | 8/2007 | Heaton et al. |
| 7,406,710 | B1 | 7/2008 | Zellner et al. |
| 7,429,921 | B2 | 9/2008 | Seeley et al. |
| 7,440,554 | B2 | 10/2008 | Elliot et al. |
| 7,542,721 | B1 | 6/2009 | Bonner et al. |
| 7,558,379 | B2 | 7/2009 | Winick |
| 7,593,512 | B2 | 9/2009 | Elliot et al. |
| 7,593,513 | B2 | 9/2009 | Muller |
| 7,613,278 | B2 | 11/2009 | Elliot et al. |
| 7,619,512 | B2 | 11/2009 | Trundle et al. |
| 7,633,385 | B2 | 12/2009 | Cohn et al. |
| 7,653,186 | B2 | 1/2010 | Hosain et al. |
| 7,734,020 | B2 | 6/2010 | Elliot et al. |
| 7,751,540 | B2 | 7/2010 | Whitfield et al. |
| 7,778,394 | B2 | 8/2010 | Small et al. |
| 7,820,841 | B2 | 10/2010 | Van Toor et al. |
| 7,848,505 | B2 | 12/2010 | Martin et al. |
| 7,853,200 | B2 | 12/2010 | Blum et al. |
| 7,855,635 | B2 | 12/2010 | Cohn et al. |
| 7,911,341 | B2 | 3/2011 | Raji et al. |
| 7,920,841 | B2 | 4/2011 | Martin et al. |
| 7,920,842 | B2 | 4/2011 | Martin et al. |
| 7,920,843 | B2 | 4/2011 | Martin et al. |
| 7,961,088 | B2 | 6/2011 | Watts et al. |
| 8,022,807 | B2 | 9/2011 | Martin et al. |
| 8,073,931 | B2 | 12/2011 | Dawes et al. |
| 8,116,724 | B2 | 2/2012 | Peabody |
| 8,214,494 | B1 | 7/2012 | Slavin |
| 8,335,842 | B2 | 12/2012 | Raji et al. |
| 8,350,694 | B1 | 1/2013 | Trundle et al. |
| 8,395,494 | B2 | 3/2013 | Trundle et al. |
| 8,456,293 | B1 | 6/2013 | Trundle et al. |
| 8,473,619 | B2 | 6/2013 | Baum et al. |
| 8,478,844 | B2 | 7/2013 | Baum et al. |
| 8,493,202 | B1 | 7/2013 | Trundle et al. |
| 8,520,072 | B1 | 8/2013 | Slavin et al. |
| 8,525,665 | B1 | 9/2013 | Trundle et al. |
| 8,626,151 | B2 | 1/2014 | Beppler et al. |
| 2002/0103898 | A1 | 8/2002 | Moyer |
| 2002/0147982 | A1 | 10/2002 | Naidoo et al. |
| 2002/0176581 | A1 | 11/2002 | Bilgic |
| 2002/0177428 | A1 | 11/2002 | Menard et al. |
| 2003/0027547 | A1 | 2/2003 | Wade |
| 2003/0071724 | A1 | 4/2003 | D'Amico |
| 2003/0128115 | A1 | 7/2003 | Giacopelli et al. |
| 2004/0005044 | A1 | 1/2004 | Yeh |
| 2004/0086088 | A1 | 5/2004 | Naidoo |
| 2004/0086093 | A1 | 5/2004 | Schranz |
| 2005/0099893 | A1 | 5/2005 | Jyrinki |
| 2006/0023848 | A1 | 2/2006 | Mohler et al. |
| 2006/0176167 | A1 | 8/2006 | Dohrmann |
| 2006/0239250 | A1 | 10/2006 | Elliot et al. |
| 2007/0115930 | A1 | 5/2007 | Reynolds et al. |
| 2007/0143838 | A1 | 6/2007 | Milligan |
| 2007/0155412 | A1 | 7/2007 | Kalsukis |
| 2008/0084291 | A1 | 4/2008 | Campion, Jr. |
| 2008/0117029 | A1 | 5/2008 | Dohrmann et al. |
| 2008/0191861 | A1* | 8/2008 | Mason ..... G08B 25/001 340/506 |
| 2008/0191863 | A1 | 8/2008 | Boling |
| 2009/0017757 | A1 | 1/2009 | Koga |
| 2009/0077622 | A1 | 3/2009 | Baum et al. |
| 2009/0213999 | A1 | 8/2009 | Farrand |
| 2009/0248967 | A1 | 10/2009 | Sharma et al. |
| 2009/0264155 | A1 | 10/2009 | Nakayama et al. |
| 2009/0274104 | A1 | 11/2009 | Addy |
| 2010/0007488 | A1 | 1/2010 | Sharma et al. |
| 2010/0052890 | A1 | 3/2010 | Trundle |
| 2010/0121948 | A1 | 5/2010 | Procopio |
| 2010/0277271 | A1 | 11/2010 | Elliot et al. |
| 2010/0277302 | A1* | 11/2010 | Cohn ..... G08B 25/001 340/514 |
| 2010/0289643 | A1 | 11/2010 | Trundle |
| 2010/0289644 | A1 | 11/2010 | Slavin |
| 2011/0065414 | A1 | 3/2011 | Frenette |
| 2011/0156904 | A1* | 6/2011 | Gilbert ..... G08B 25/008 340/541 |
| 2011/0169628 | A1 | 7/2011 | Elliot |
| 2012/0027010 | A1 | 2/2012 | Elliot |
| 2012/0139718 | A1 | 6/2012 | Foisy et al. |
| 2012/0250833 | A1 | 10/2012 | Smith et al. |
| 2012/0250834 | A1 | 10/2012 | Smith |
| 2012/0275588 | A1 | 11/2012 | Gregory |
| 2013/0189946 | A1 | 7/2013 | Swanson |
| 2013/0194091 | A1 | 8/2013 | Trundle |
| 2013/0215266 | A1 | 8/2013 | Trundle |
| 2013/0234840 | A1 | 9/2013 | Trundle |
| 2013/0321150 | A1* | 12/2013 | Koenig ..... G08B 25/008 340/541 |

* cited by examiner

METHOD AND SYSTEM FOR MITIGATING INVASION RISK ASSOCIATED WITH STRANGER INTERACTIONS IN A SECURITY SYSTEM ENVIRONMENT

FIELD OF THE TECHNOLOGY

The present technology relates to security systems and more particularly to technology for mitigating an invasion risk associated with a user interacting with a stranger, for example when the user responds to a supposed deliveryman knocking on the front door of a premises.

BACKGROUND

A homeowner responding to a stranger knocking on the front door faces risk by responding. While the stranger may appear to be a deliveryman (or salesman, utility worker, etc.), the stranger may be an intruder masking as a deliveryman who will strike when the responder opens the door. While conventional security systems provide protection against various threats, this scenario poses unique security challenges. The responder is particularly vulnerable when he or she disarms the security system to open the door.

Accordingly, need is apparent for improvements in security system technology. Needs exist to protect users when responding to or otherwise interacting with strangers. A capability addressing one or more such needs, or some other related deficiency in the art, would support enhanced security.

SUMMARY

A security system can provide security, fire, protection, or other alarm services for a premises, such as for a building or other property, and/or for an associated person, such as a user or owner of the premises. A method can mitigate invasion risk associated with the person interacting with a stranger, for example someone who appears to be a deliveryman ringing a doorbell of the premises. The user can make an entry into a user interface of the security system in preparation for interacting with the stranger, such as when the user plans to answer the front door. The entry can start a timer. If the user does not make a second entry within a designated period of time indicating that the interaction safely concluded, the security system can raise an alarm or dispatch help.

The foregoing discussion of security systems and measures is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

Figure 1:
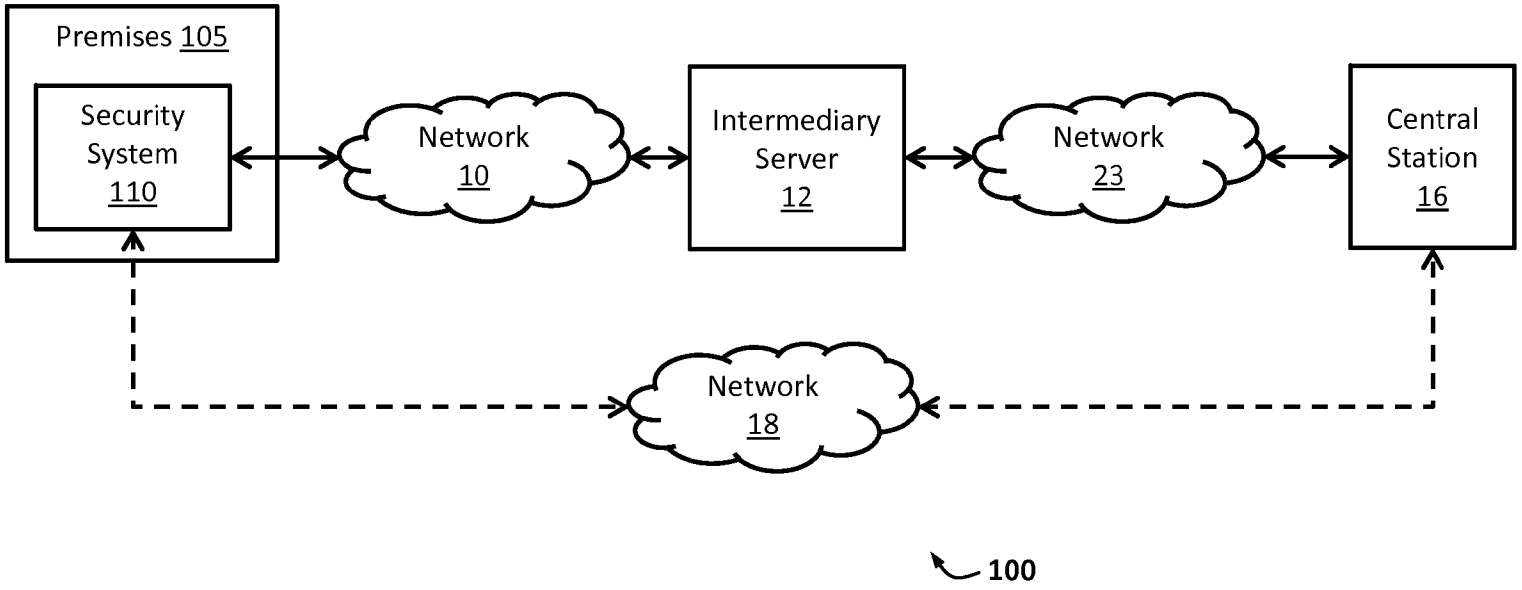
FIG. 1 is a functional block diagram of a system in which a security system monitors a premises and may communicate with a central station via an intermediary server or directly in accordance with some example embodiments of the present technology.

Many aspects of the technology can be better understood with reference to the above drawings. The elements and features shown in the drawings are not necessarily to scale, emphasis being placed upon clearly illustrating the principles of exemplary embodiments of the present technology. Moreover, certain dimensions may be exaggerated to help visually convey such principles.

DESCRIPTION OF EXAMPLE EMBODIMENTS

Representative embodiments of the present technology relate generally to providing security, fire, protection, or other appropriate alarm services. The services may provide personal protection in connection with protecting property, such as premises, buildings, vehicles, etc.

The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples," "embodiments," "example embodiments," or "exemplary embodiments" given herein are intended to be non-limiting and among others supported by representations of the present technology.

Some of the embodiments may comprise or involve processes that will be discussed below. Certain steps in the processes may need to naturally precede others to achieve intended functionality. However, the technology is not limited to the order of the steps described to the extent that reordering or re-sequencing does not render the processes useless or nonsensical. Thus, it is recognized that some steps may be performed before or after other steps or in parallel with other steps without departing from the scope and spirit of this disclosure.

Technology for providing invasion defense will now be described more fully with reference to FIGS. 1-6, which describe representative embodiments of the present technology.

Turning now to FIG. 1, this figure illustrates a functional block diagram of an example system 100 in which a security system 110 monitors a premises 105 and may communicate with a central station 16 via an intermediary server 12 or directly according to some embodiments of the present technology. FIG. 1 illustrates a representative, but not limiting, operating environment for an example embodiment of technology for invasion protection, as will be discussed in further detail below.

The central station 16 may be characterized as an alarm monitoring center or as a central monitoring station. In an example embodiment, the central station 16 provides alarm monitoring services for multiple security systems 110 located at different, geographically dispersed premises 105, one instance of which is illustrated in FIG. 1.

In some example embodiments, the security system 110 communicates with the central station 16 only over the network 18. In various example embodiments, the network 18 can comprise one or more of a cellular network, the public switched telephone network (PSTN), the Internet, a packet-switched network, a Voice-over Internet Protocol (VoIP) network, an IP network, a private network, or other appropriate network or combination of networks. In some embodiments, the network 18 can provide a communication path between the security system 110 and the central monitoring station 16 that may be implemented via an IP network capable of communicating using IP telephony, Internet telephony, VoBB, broadband telephony, IP communications, broadband phone, VoLTE, or other appropriate technology. A VoIP communication of alarm event data can be carried via a 2G, 3G, 4G, or other cellular, Wi-Fi, DECT, or other wireless transport mechanism, for example.

In some example embodiments, the security system 110 communicates with the central station 16 only via the intermediary server 12. In the illustrated embodiment, the network 10 links the intermediary server 12 to the security system 110, and the network 23 links the intermediary server to the central station. Thus, bidirectional communications can flow between the security system 110 and the central station 16 via a series combination of the network 10, the network 23, and the intermediary server 12.

In various example embodiments, the network 10 can comprise one or more of a cellular network, the PSTN, the Internet, a packet-switched network, a VoIP network, an IP network, a private network, or other appropriate network or combination of networks. In various example embodiments, the network 23 can comprise one or more of a cellular network, the PSTN, the Internet, a packet-switched network, a VoIP network, an IP network, a private network, or other appropriate network or combination of networks. In some embodiments, the network 10 and/or the network 23 can provide a communication channel connecting the security system 110, the intermediary server 12, and the central monitoring station 16 that may be implemented via one or more IP networks capable of communicating using IP telephony, Internet telephony, VoBB, broadband telephony, IP communications, broadband phone, VoLTE, or other appropriate technology. A VoIP communication of alarm event data can be carried via a 2G, 3G, 4G, or other cellular, Wi-Fi, DECT, or other wireless transport mechanism, for example.

In some example embodiments, the security system 110 communicates with the central station 16 via the intermediary server 12 and via the network 18, either simultaneously or intermittently. Accordingly, the system 100 can provide the security system 110 with parallel, redundant, or alternative communication paths to the central station 16.

In some embodiments, when the security system 110 initiates a communications connection to the central station 16, the connection can extend in a digital format (or in a combination of digital and analog formats) to the central station 16. In some example embodiments, VoIP formatted information can flow bidirectionally between the security system 110 and the central station 16. The intermediary server 12, for example, can maintain VoIP formatting while processing communications, including while varying one or more fields of a VoIP format, readdressing, changing headers, adjusting protocol specifics, etc.

The intermediary server 12 may also be characterized as an intermediate server and in some embodiments may comprise a communications gateway. In the illustrated embodiment, the intermediary server 12 is offsite of the premises 105. In a representative embodiment, the intermediary server 12 additionally serves the security system 110 at the premises 105 as well as other security systems at other premises. Accordingly, the illustrated intermediary server 12 can provide a gateway for varied security systems that may be geographically dispersed. In some example embodiments, the intermediary server 12 may comprise or be characterized as a middleware server.

A representative server or gateway is disclosed in U.S. patent application Ser. No. 13/413,333 (filed Mar. 6, 2012 and entitled "Delivery of Alarm System Event Data and Audio Over Hybrid Networks") and Ser. No. 13/438,941 (filed Apr. 4, 2012 and entitled "Delivery of Alarm System Event Data and Audio"). The content and complete and entire disclosure made by each of these identified patent applications are hereby fully incorporated herein by reference.

The intermediary server 12 communicates with the central station 16, which may be remote from the intermediary server 12. However in some example embodiments, the intermediary server 12 is collocated with the central station 16. Thus, the central station 16 may comprise one or more intermediary servers 12 that provide connectivity to various security systems. The central station 12 typically provides monitoring services that may include human operators interacting with security systems and users and dispatching emergency personnel when conditions warrant.

In some embodiments, a digital communication connection extends between the intermediary server 12 and a data router (not illustrated) that is located on the premises 105 and that is associated with the security system 110. In such an embodiment, the network 10 can comprise the Internet providing a digital connection to the intermediary server 12. In one example embodiment, an analog telephone adapter (not illustrated) and/or a router (not illustrated) addresses information packets of VoIP communications to the intermediary server 12.

In some example embodiments, the intermediary server 12 analyzes the received signals for account verification and routing purposes, for example in accordance with typical practices of the alarm monitoring service industry. The intermediary server 12 can direct a digital connection to the central station 16 that is associated with the verified account of the security system 110 that originated an event report. For example, the intermediary server 12 may readdress packets to the central station 16, with both networks 10, 23 comprising the Internet or other appropriate IP network. The communication path between the intermediary server 12 and the central station 16 (as well the communication path between the intermediary server 12 and the security system 110) can be implemented by an IP network capable of communicating utilizing VoIP, IP telephony, Internet telephony, VoBB, broadband telephony, IP communications, broadband phone, or VoLTE, for example.

In some embodiments, upon communication receipt at the central station 16, a data switch (not illustrated) and an associated automation module (not illustrated) route information within the station 16, for example activating displays and alerts as appropriate. In some example embodiments, an IP connection is terminated at such a data switch located within the central station 16. In some example embodiments, the central monitoring station 16 utilizes an internal IP network infrastructure, so that IP packets are routed throughout the station 16.

For example, event data can be forwarded by a data switch and received and processed by an associated automation module that activates displays and alerts. Depending upon predetermined options associated with the account of the security system 110 that originated the event, event data may further trigger interconnection of a VoIP telephone call to enable a human operator of the central station 16 to communicate with an onsite speaker and microphone (not illustrated) of the security system 110. Accordingly, the type of alarm event may be identified so that the operator or other personnel may act on it, for example to dispatch emergency service personnel.

Figure 2:
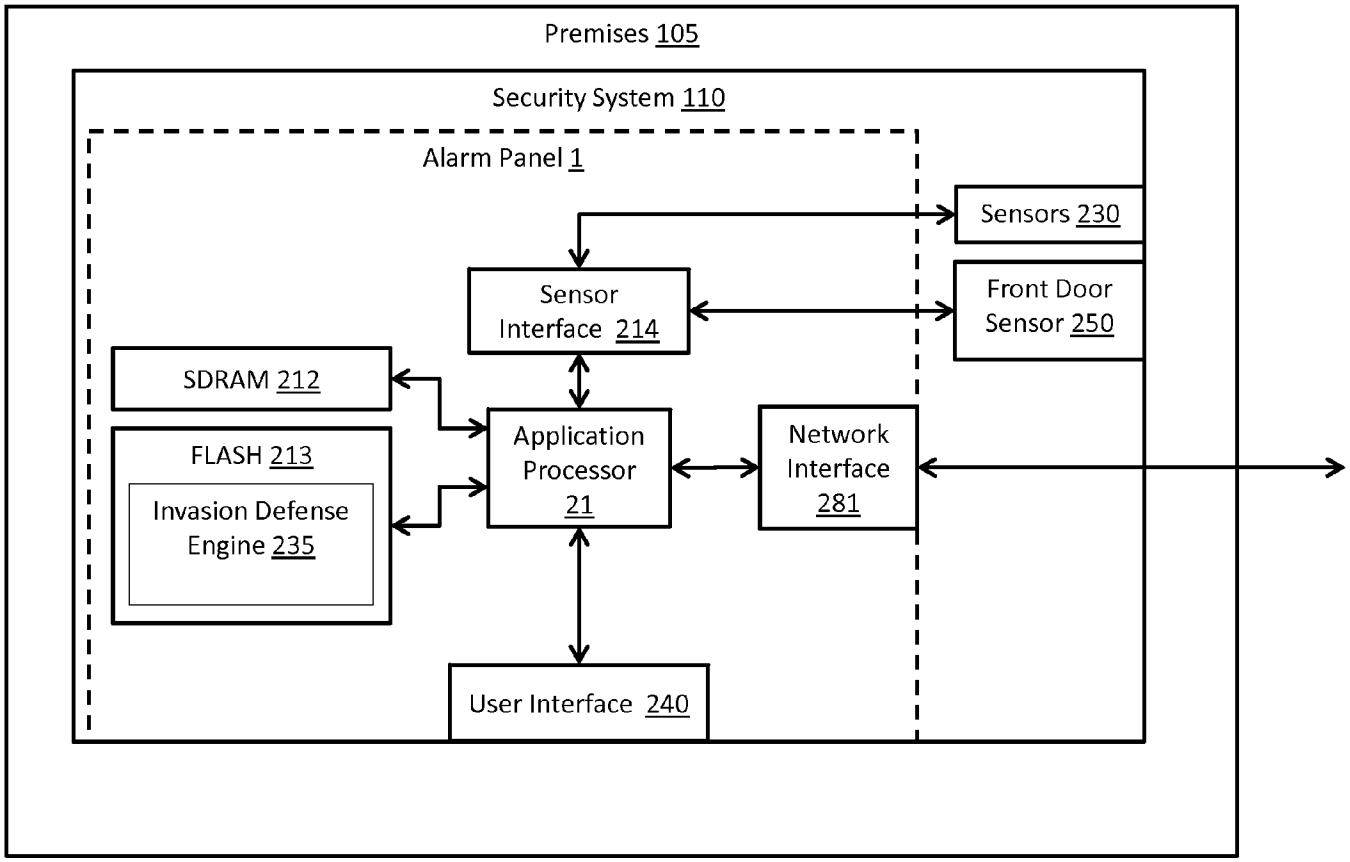
FIG. 2 is a functional block diagram of the security system in accordance with some example embodiments of the present technology.

Turning now to FIG. 2, this figure illustrates an example functional block diagram of the security system 110 according to some embodiments of the present technology. In the illustrated example, the security system 110 comprises an alarm panel 1, a front door sensor 250, and other alarm sensors 230. The sensors 230 may monitor other doors, windows, smoke, and so forth.

As illustrated, the alarm panel 1 of the security system 110 comprises a user interface 240 through which the user can enter commands and receive information. In some embodiments, the user interface 240 comprises a keypad that is wired to an application processor 21 of the alarm panel 1. Such a keypad may be mounted to a wall in an appropriate place, for example, and may be collocated with the application processor 21 or may be located in a different area of the premises 105. In some embodiments, the user interface 240 comprises a smartphone or other cellular or RF device that may communicate with the application processor 12 via wireless communication. The user interface 240 may comprise a graphical user interface (GUI) executed on smartphone or personal computer, for example.

The illustrated alarm panel 1 further comprises a network interface 281 for communicating with the central station 16 either directly or through the intermediary server 12 as discussed above.

In the illustrated embodiment, the alarm panel 1 comprises a sensor interface 214 that interfaces the sensors 230 and the front door sensor 250 with the application processor 21, so that the application processor 21 can receive and act upon sensor signals. In some embodiments, the application processor 21 comprises an embedded processor for typical alarm functionality associated with interfacing with alarm sensors 230, 250 via the sensor interface 214. In an example embodiment, the application processor 21 can be microprocessor based, for example, and has associated memory. In the illustrated embodiment, the memory includes SDRAM memory 212 and FLASH memory 213.

As illustrated, an invasion defense engine 235 is stored in the FLASH memory 213. The invasion defense engine 235 can comprise instructions for providing a user with a defense against invasion by a stranger who is seeking to interact with the user or to gain access to the premises 105. The invasion defense engine 235 can comprise computer executable instructions for executing the process 300 illustrated in FIG. 3, with some sub-process embodiments illustrated in FIGS. 4, 5, and 6, for example.

In some embodiments, the invasion defense engine 235 is stored in memory of the intermediary server 12 and is executed by a computer of the intermediary server 12. In some embodiments, the invasion defense engine 235 is stored in memory of the central station 16 and is executed by a computer of the central station 16.

In some embodiments, the invasion defense engine 235 is distributed between and stored in memory of any two or more of the central station 16, the intermediary server 12, and the security system 110. In some embodiments, execution of the invasion defense engine 235 is distributed between computers of any two or more of the central station 16, the intermediary server 12, and the security system 110.

Example embodiments of the invasion defense engine 235 will be discussed in further detail below with reference to FIGS. 3, 4, 5, and 6.

Figure 3:
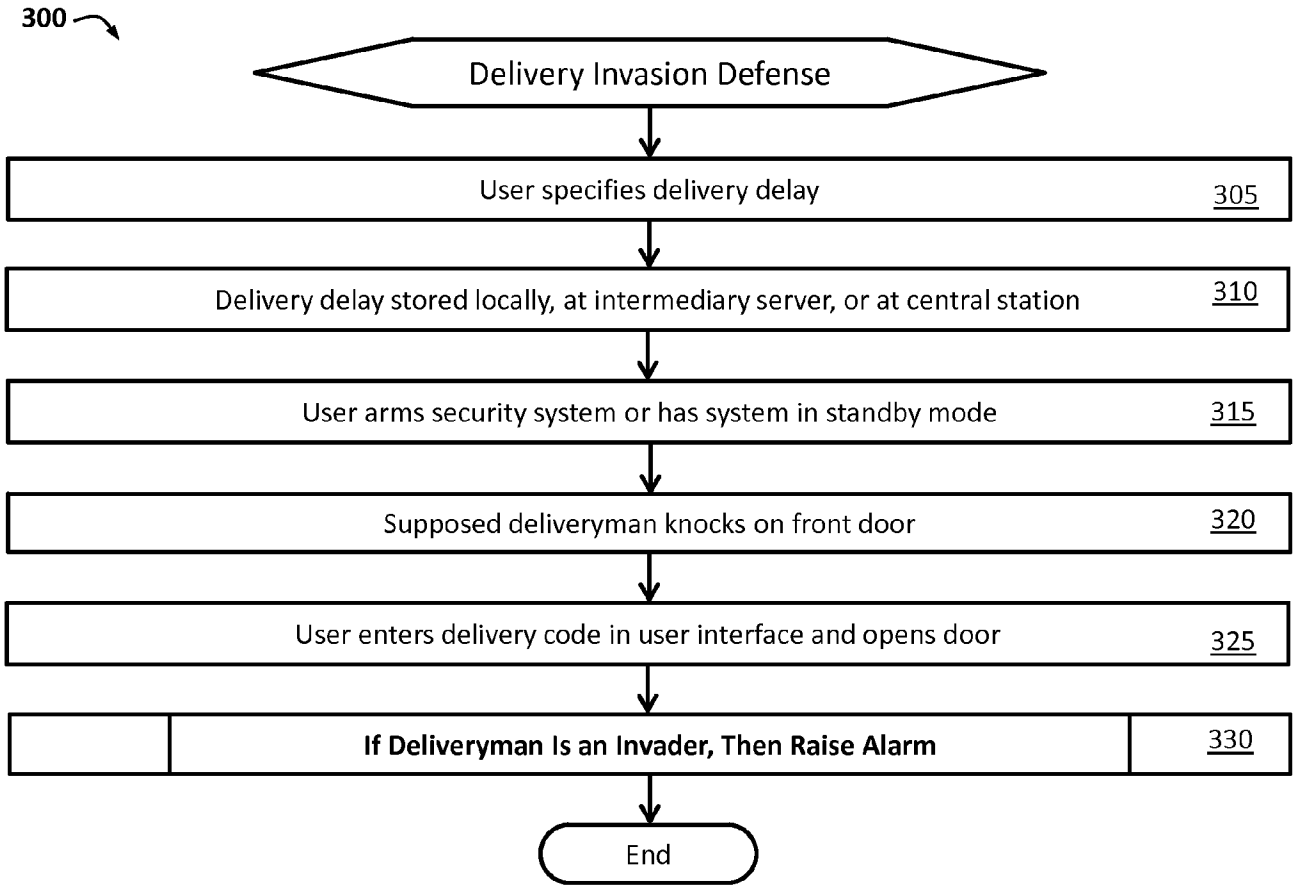
FIG. 3 is a flowchart of a process for defending against invasion by a stranger posing as a deliveryman or other legitimate person in accordance with some example embodiments of the present technology.

Turning now to FIG. 3, this figure illustrates a flowchart of an example process 300 for defending against an invasion by a stranger posing as a deliveryman or other legitimate person according to some embodiments of the present technology. Process 300, which is entitled Delivery Invasion Defense (without suggesting any limitations), can be executed by one or more of the central station 16, the intermediary server 12, and the security system 110.

At block 305 of process 300, the user enters into the user interface 240 a delay of sufficient duration to allow interaction with a legitimate deliveryman or other stranger seeking interaction or access, for example a salesman, service personnel, or utility worker. This "delivery delay" may be longer than another alarm delay that allows the user time to access and disarm the security system 110 when the user returns home and enters the front door with the system 110 armed.

At block 310 of process 300, the delivery delay is stored at the security panel 1, the intermediary server 12, or at the central station 16 (or at two or more of these locations or at another appropriate site).

At block 315, the user arms the security system 110. Alternatively, the user may have the security system 110 in a standby mode.

At block 320, a stranger requests or otherwise seeks interaction with the user or access to the premises 105. For example, the stranger may be a supposed deliveryman knocking on a front door (or ringing a doorbell) at the premises 105.

At block 325, the user makes an entry into the user interface 240 to notify the security system 110 that the user intends to open the front door, which is detected by the front door sensor 250, and interact with the stranger.

Figure 4:
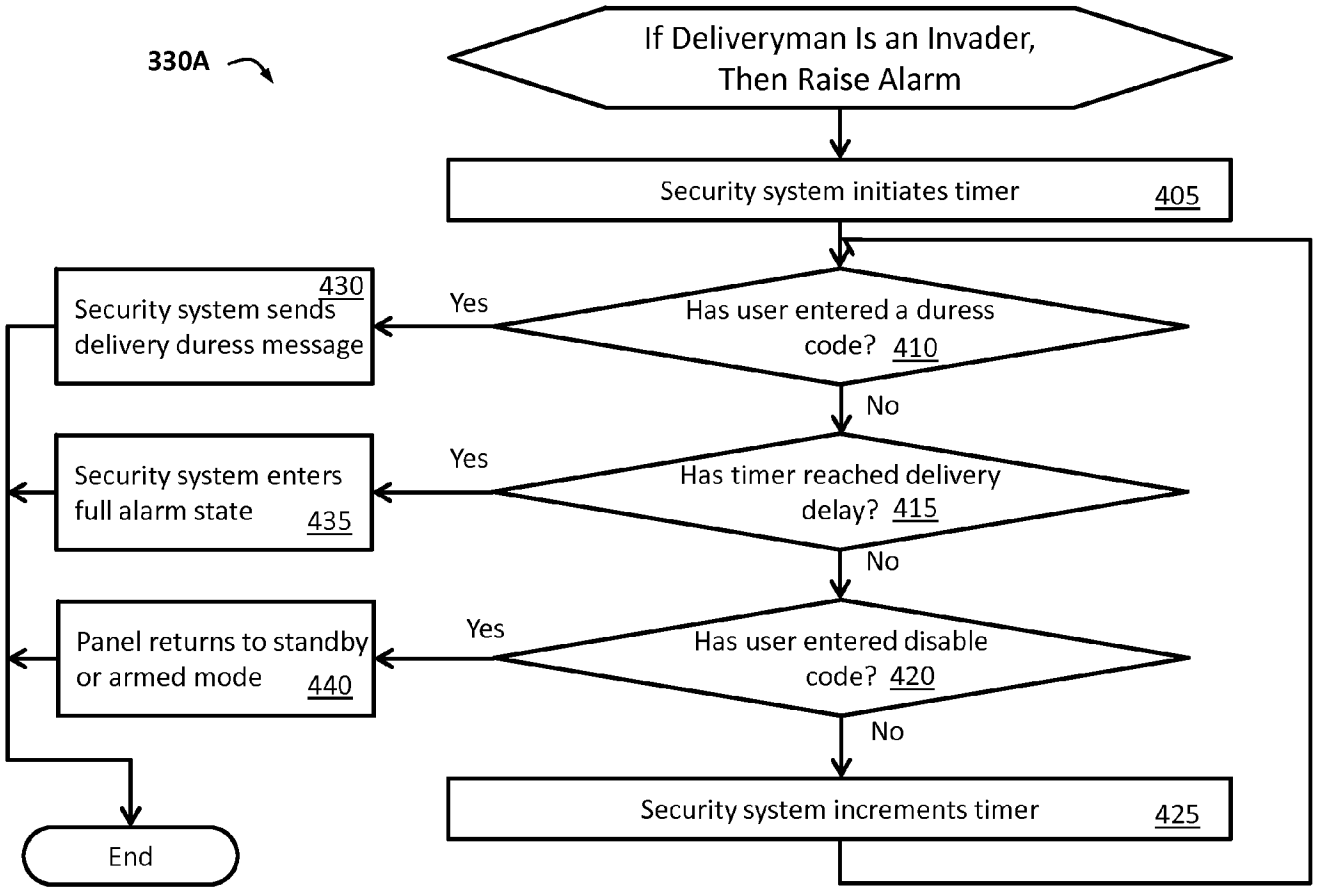
FIG. 4 is a flowchart of an embodiment of a sub-process for invasion defense that may be implemented in connection with the process of FIG. 3 in accordance with some example embodiments of the present technology.
Figure 5:
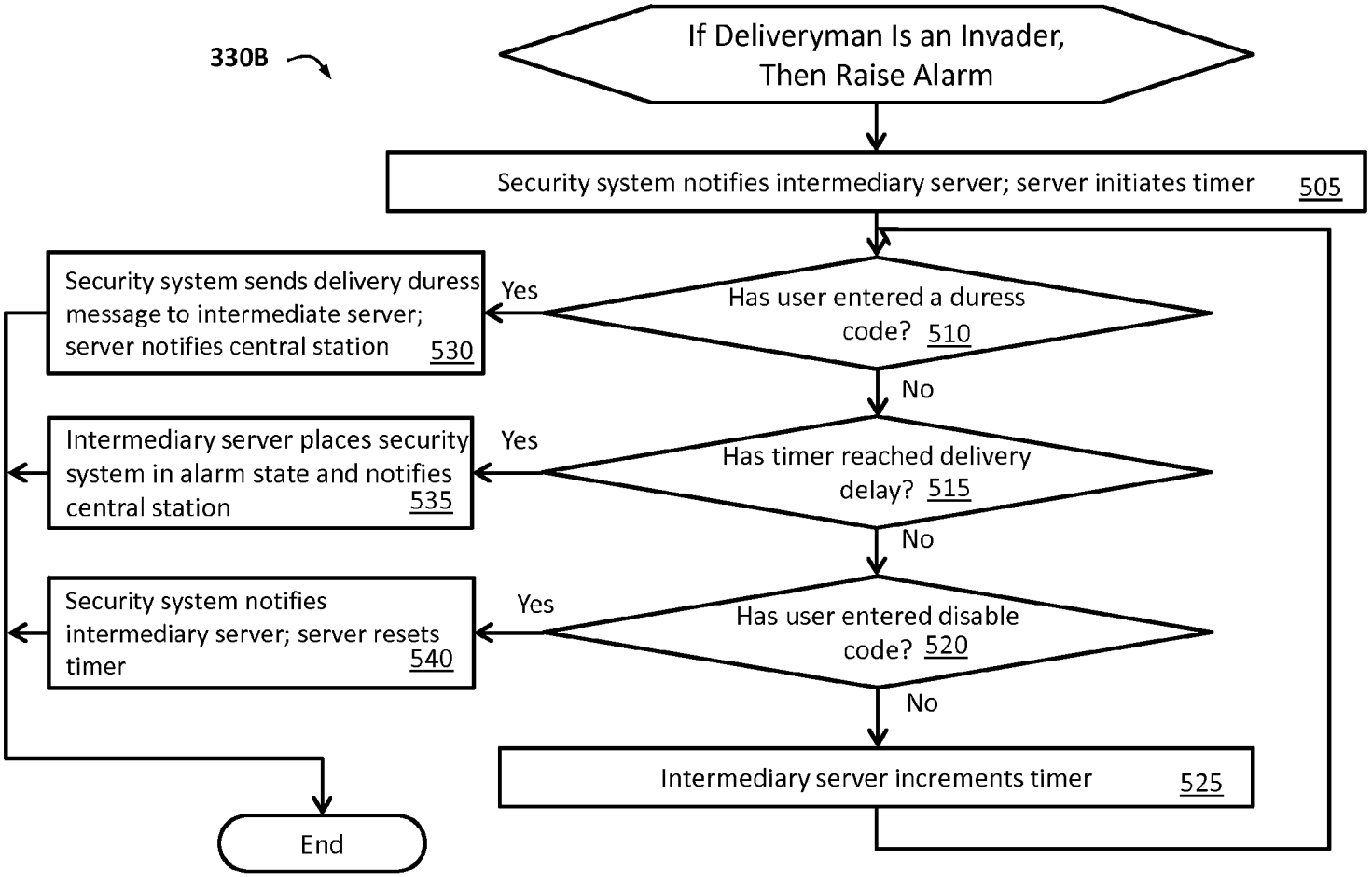
FIG. 5 is a flowchart of an embodiment of another sub-process for invasion defense that may be implemented in connection with the process of FIG. 3 in accordance with some example embodiments of the present technology.
Figure 6:
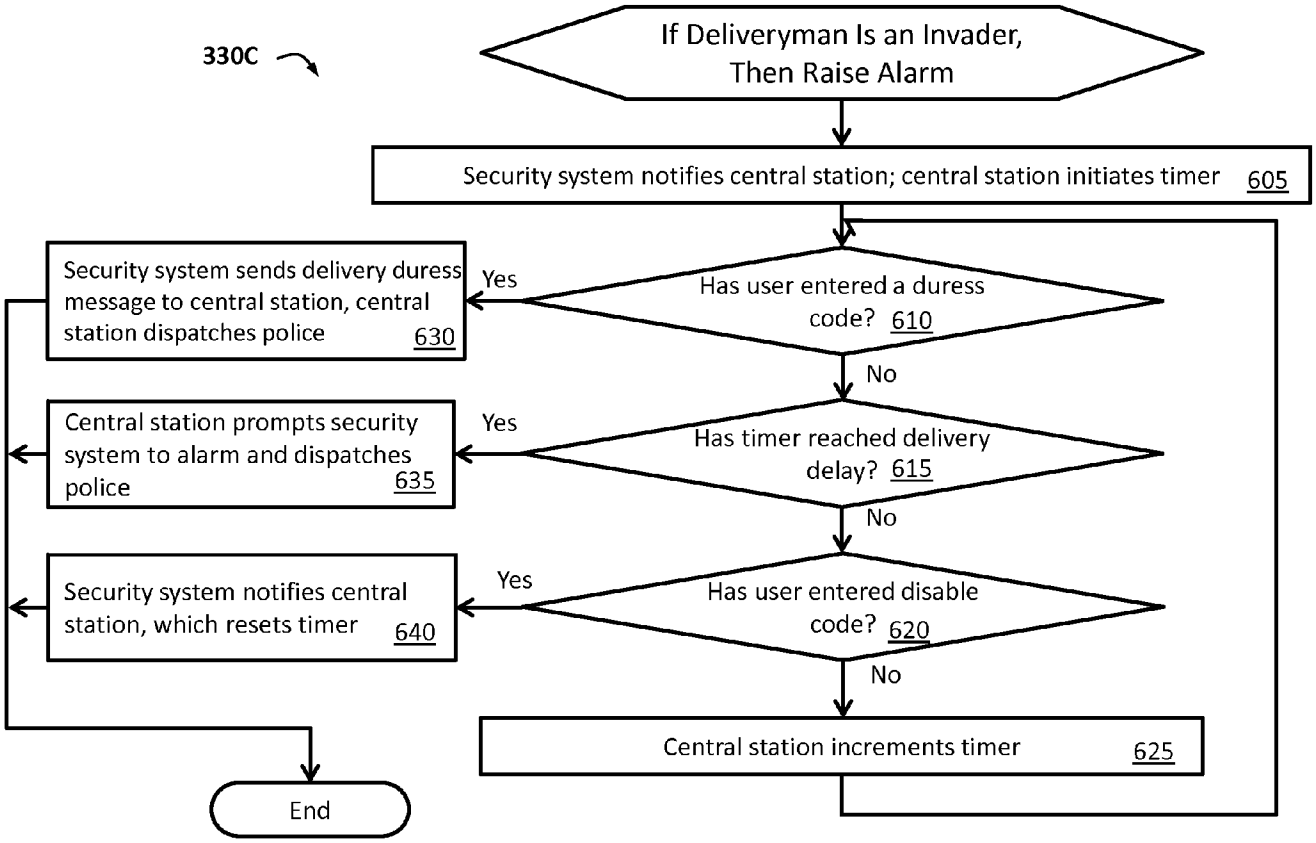
FIG. 6 is a flowchart of an embodiment of another sub-process for invasion defense that may be implemented in connection with the process of FIG. 3 in accordance with some example embodiments of the present technology.

At block 330 one or more of the security system 110, the intermediary server 12, and the central station 16 mitigate the threat that the stranger is actually a would-be intruder. Block 330 is labeled (without suggesting limitation) if deliveryman is an invader, then raise alarm. FIG. 4 provides a flowchart for such mitigation utilizing blocks that can be computer implemented at the security system 110. FIG. 5 provides a flowchart for such mitigation utilizing blocks that can be computer implemented at the intermediary server 12. FIG. 6 provides a flowchart for such mitigation utilizing blocks that can be computer implemented at the central station 16.

Turning now to FIG. 4, this figure illustrates a flowchart of an embodiment of an example sub-process (process 330A) for invasion defense that may be implemented within or in connection with the process 300 of FIG. 3 according to some embodiments of the present technology. For example, one or more computers executing process 300 may call process 330A as a subroutine. In an example embodiment, a program or instruction set for process 300A can be stored in memory at the security system 110 and computer executed.

At block 405, the security system 110 initiates a timer to determine whether the delivery delay has been exceeded.

At inquiry block 410, the security system 110 monitors the user interface 240 to determine whether the user has made a duress entry indicating that the stranger is an intruder who has forced the user to make a disarming or all-clear entry into the security system 110. The duress entry can be a code that seems to the intruder like a disarming entry but in fact triggers a silent alarm or a call for help.

If the security system 110 determines at inquiry block 410 that the user has entered a duress code, then block 430 executes. At block 430, the security system 110 sends a duress message to the central station 16, either directly or via the intermediary server 12. The duress message notifies the central station 16 that the user is under duress. An operator at the central station 16 may open a voice channel to the alarm panel 1 or dispatch police or other emergency personnel. Process 330A ends following execution of block 430.

If execution of inquiry block 410 returns a negative determination, then inquiry block 415 executes. At inquiry block 415, the security system 110 determines whether the timer, which was initiated at block 405, has reached the delivery delay that the user entered at block 305 of process 300.

If the delivery delay has been reached, then block 435 executes and the security system 110 enters a full alarm state. The security system 110 may sound an audible alarm, notify the central station 16 to send help, open a voice channel to an operator, or take other actions as may be programmed by the user or the security system manufacturer or as otherwise designated by an alarm monitoring service provider. Process 330A ends following execution of block 435.

Process 330A executes inquiry block 420 following a negative determination at inquiry block 415. At inquiry block 420, the security system 110 determines whether the user has made a disarming or disabling entry, indicating that all is clear. If the user has made such an entry, then at block 440, the alarm panel 1 returns to the prior state, which may be a standby mode or an armed mode as discussed above with reference to block 315 of process 300. Process 330A ends following execution of block 440.

If inquiry block 420 returns a negative determination, then the security system 110 increments the timer at block 425 so that the timer continues to measure elapsed time. Process 330A then loops back to block 410 and iterates until block 410, 415, or 420 returns a positive determination.

Turning now to FIG. 5, this figure illustrates a flowchart of an embodiment of another example sub-process (process 330B) for invasion defense that may be implemented within or in association with the process 300 of FIG. 3 according to some embodiments of the present technology. For example, one or more computers executing process 300 may call process 330B as a subroutine. In an example embodiment, program instructions for process 300B can be stored in memory at the intermediary server 12 and computer executed. For example, a timer function can be implemented at the intermediary server 12.

At block 505, the security system 110 notifies the intermediary server 12 of the user entry made at block 325 of process 300. The intermediary server 12 initiates the timer.

At inquiry block 510, the security system 110 determines whether the user has entered a duress code. If so, the security system 110 notifies the intermediary server 12 at block 530, and the intermediary server 12 notifies the central station 16. The central station 16 can dispatch emergency personnel as discussed above.

At inquiry block 515, the intermediary server 12 determines if the timer initiated at block 505 has reached the delivery delay. If so, at block 535, the intermediary server 12 sends a prompt to the security system 110 to go into alarm state and notifies the central station 16, which may dispatch emergency personnel as discussed above.

At inquiry block 520, the security system 110 determines whether the user has made a disable entry. If so, then the security system 110 notifies the intermediary server 12, and the server 12 resets the timer.

If inquiry block 520 returns a negative determination, then the intermediary server 12 increments the timer at block 525 so that the timer continues to measure elapsed time. Process 330B then loops back to block 510 and iterates until block 510, 515, or 520 returns a positive determination.

Turning now to FIG. 6, this figure illustrates a flowchart of an embodiment of another example sub-process (process 330C) for invasion defense that may be implemented within or in association with the process 300 of FIG. 3 according to some embodiments of the present technology. For example, one or more computers executing process 300 may call process 330C as a subroutine. In an example embodiment, programmable instructions for process 300C can be stored in memory at the central station 16 and computer executed. For example, a timer function can be implemented at the central station 16.

At block 605, the security system 110 notifies the central station 16 of the user entry made at block 325 of process 300. The central station 16 initiates the timer.

At inquiry block 610, the security system 110 determines whether the user has entered a duress code. If so, the security system 110 notifies the central station 16 at block 630. The central station 16 can dispatch emergency personnel or otherwise intervene as discussed above.

At inquiry block 615, the central station 16 determines if the timer initiated at block 605 has reached the delivery delay. If so, at block 635, the central station 16 sends a prompt to the security system 110 to go into alarm state and may dispatch emergency personnel as discussed above, open a voice channel to the security system 110, or otherwise intervene as discussed above.

At inquiry block 620, the security system 110 determines whether the user has made a disable entry. If so, then the security system 110 notifies the central station 16, which resets the timer.

If inquiry block 620 returns a negative determination, then the central station 16 increments the timer at block 625 so that the timer continues to measure elapsed time. Process 330C then loops back to block 610 and iterates until block 610, 615, or 620 returns a positive determination.

Technology for security and invasion protection has been disclosed. From the description, it will be appreciated that embodiments of the present technology overcome limitations of the prior art. Those skilled in the art will appreciate that the present technology is not limited to any specifically discussed application or implementation and that the embodiments described herein are illustrative and not restrictive. From the description of the exemplary embodiments, equivalents of the elements shown therein will suggest themselves to those skilled in the art, and ways of constructing other embodiments of the present technology will appear to practitioners of the art.

What is claimed is:

1. A system for providing security comprising:

an alarm interface for connecting to one or more sensors disposed at a premises;

a user interface for receiving entries from a user;

a communication interface for remote communication; and a processor that is connected to the alarm interface to receive signals from the one or more sensors, to the user interface to receive the entries from the user, and to the communication interface for off-premises communication;

wherein the processor is operable to:

determine if a first user entry indicates an interaction with a person posing a potential security risk;

if the first user entry indicates the interaction with the person posing the potential security risk, then monitor for a second user entry indicating that the person does not pose an actual security risk; and if the second user entry is not detected within a specified time period, then transmit an alarm notification to the communication interface.

2. The system of claim 1, wherein the processor is further operable to:

monitor for a third user entry indicating duress associated with the interaction; and if the third user entry is detected, then transmit to the communication interface a duress notification.

3. The system of claim 2, wherein the duress notification comprises a silent alarm.

4. The system of claim 1, wherein the communication interface comprises an interface to a middleware server.

5. The system of claim 1, wherein the communication interface comprises an interface to a central station.

6. The system of claim 1, wherein computer executable instructions that are stored in memory of the processor are for:

determining if the first user entry indicates the interaction with the person posing the potential security risk;

if the first user entry indicates the interaction with the person posing the potential security risk, then monitoring for the second user entry indicating that the person does not pose the actual security risk; and if the second user entry is not detected within the specified time period, then transmitting the alarm notification to the communication interface.

7. An intermediary server comprising:

a first interface for communicating with a security system disposed at a premises;

a second interface for communicating with a central station; and a processor that is connected to the first and second interfaces and that is operable to:

determine if a first message received via the first interface indicates an interaction at the premises between a stranger and a user;

if the first message indicates the interaction, then monitor for a second message indicating that the user has assessed the stranger as not posing a security threat; and if the second message is not detected within a specified time period, then transmit an alarm notification to the second interface.

8. The intermediary server of claim 7, wherein the processor is further operable to:

monitor for a third message indicating user duress associated with the interaction; and if the third message is detected, then transmit a duress notification to the second interface.

9. The intermediary server of claim 8, wherein the duress notification comprises a silent alarm.

10. The intermediary server of claim 7, wherein the first message is received in advance of the interaction.

11. The intermediary server of claim 7, wherein an Internet interface comprises the first and second interfaces.

12. The intermediary server of claim 7, wherein the first message is about the stranger approaching a front door of the premises.

13. The intermediary server of claim 7, wherein the security system is operable to monitor the premises.

14. The intermediary server of claim 7, wherein the intermediary server is collocated with the central station.

15. The intermediary server of claim 7, wherein the intermediary server comprises a gateway.

16. A system comprising:

a computer-based processor that is connected to an interface for communicating with a security system and to a memory for executing instructions stored in the memory; and computer-executable instructions stored in the memory for performing the steps of:

determining if a first message received via the interface is about an approach by a person that a user has deemed to pose a potential security threat;

if the first message is about the approach, then monitoring for a second message indicating that the user has determined that the potential security threat is not an actual security threat; and if the second message is not detected within a specified time period, then deeming that the potential security threat is the actual security threat.

17. The system of claim 16, wherein computer-executable instructions stored in the memory are further for performing the steps of:

monitoring during the specified time period for a third message comprising a duress code; and if the third message comprising the duress code is detected during the specified time, then determining that the person has forced the user to send the third message.

18. The system of claim 16, wherein the memory is disposed at a central station.

19. The system of claim 16, wherein the memory is disposed at an intermediary server.

20. The system of claim 16, wherein the security system is disposed at a premises, and wherein the memory is remote from the premises.

* * * * *